United States Patent [19]

Nicholson et al.

[11] Patent Number: 4,472,015

[45] Date of Patent: Sep. 18, 1984

[54] MULTIFUNCTION CONNECTOR

[75] Inventors: Judith A. Nicholson; Carl D. Taylor; Omer E. Murray, all of Hendersonville, N.C.

[73] Assignee: General Electric Company, Schenectady, N.Y.

[21] Appl. No.: 446,805

[22] Filed: Dec. 3, 1982

[51] Int. Cl.[3] ..... H01R 13/514

[52] U.S. Cl. ..... 339/156 R; 339/158; 339/198 R; 339/198 E; 339/198 P; 339/214 R

[58] Field of Search ..... 339/198 R, 198 E, 198 K, 339/198 P, 214 R, 154 R, 154 A, 154 L, 157 R, 158, 156 R

[56] References Cited

U.S. PATENT DOCUMENTS

| | | | |
|---|---|---|---|
| 3,297,864 | 1/1967 | Waldbauer | 240/25 |
| 3,474,396 | 10/1969 | Laurent | 339/198 R |
| 3,510,825 | 5/1970 | Quackenbush | 339/157 R |
| 3,917,976 | 11/1975 | Nuckolls | 315/258 |
| 4,159,500 | 6/1979 | Baumbach et al. | 339/198 R |

FOREIGN PATENT DOCUMENTS

| | | | |
|---|---|---|---|
| 55-2038 | 6/1980 | Japan | 339/198 R |

*Primary Examiner*—Joseph H. McGlynn
*Assistant Examiner*—Paula Austin
*Attorney, Agent, or Firm*—Ernest W. Legree; Philip L. Schlamp; Fred Jacob

[57] ABSTRACT

A multifunction connector block for use in a luminaire to interconnect circuit components and facilitate assembly and subsequent changeouts. A plurality of similar interconnecting strips are disposed in spaced side-by-side relationship in insulating material. The strips have terminations on one side accommodating a disconnect plug for the line supply and the lamp, and on the other side accepting individual terminal connectors from ballast components. Intermediate terminations are accessible through the top of the block to a plug-in starting aid.

7 Claims, 5 Drawing Figures

MULTIFUNCTION CONNECTOR

The invention relates to a multifunction connector for use in a luminaire to interconnect circuit components in a manner facilitating assembly at manufacture and subsequent changeouts.

BACKGROUND

Luminaires utilizing high intensity discharge lamps generally comprise a housing containing a power module supporting ballast components and an optics compartment which includes a socket for accommodating the lamp. It is necessary to interconnect the ballast components in the power module and connect the module to the lamp and to the AC supply. In order to allow the power module to be removed from the luminaire housing for changeouts, that is for testing and replacement if necessary, the connections between the module and the optics portion or the housing must be separable. A variety of terminal strips and connectors have been used for this purpose in the past.

Some high intensity discharge lamps utilizing metal vapors as the discharge medium require a starting voltage much higher than the operating voltage and this is particularly so with high pressure sodium vapor lamps. For such lamps so-called starting aids are available which are combined with otherwise conventional ballasts to generate a series of high frequency pulses which initiate the breakdown in the lamp. The common approach in regards to starting aids up to the present has been to attach the components to a flat board or to a printed circuit board. A suitable bracket is used to mount the board within the luminaire and individual connectors are used to make the necessary interconnections. Should a changeout be needed, one must dismount the board and mount another, and of course first separate and then reattach the connectors. All this entails considerable labor in the manufacturing assembly and makes changeouts for testing or replacement inconvenient.

SUMMARY OF THE INVENTION

The objects of the invention are to reduce the labor required in the manufacturing assembly of luminaire components, to make it easier to mount and connect a starting aid into the power module when desired, and to facilitate changeouts of the power module or of the starting aid.

In accordance with the invention we provide a versatile multifunction connector which has attachment terminals for leads interconnecting ballast components, a convenient plug-in termination for leads connecting the power module with the luminaire housing, and means for accommodating and connecting into circuit an optional starting aid arranged as a plug-in device.

In a preferred multifunction connector block embodying the invention, a plurality of similar interconnecting strips having standard configuration male terminals at opposite ends and female terminals in the center are embedded in an insulating plastic body. The block is intended to be mounted in the power module. The male terminals exposed on one side accept individual terminal connectors of leads from the ballast components. The male terminals exposed on the opposite side are engageable by a plug for leads connecting the power module into the luminaire housing. The block in its midportion accommodates a plug-in starting aid which makes connections into the lamp ballast circuit through the female terminals in selected ones of the interconnecting strips.

DETAILED DESCRIPTION

Figure 1:
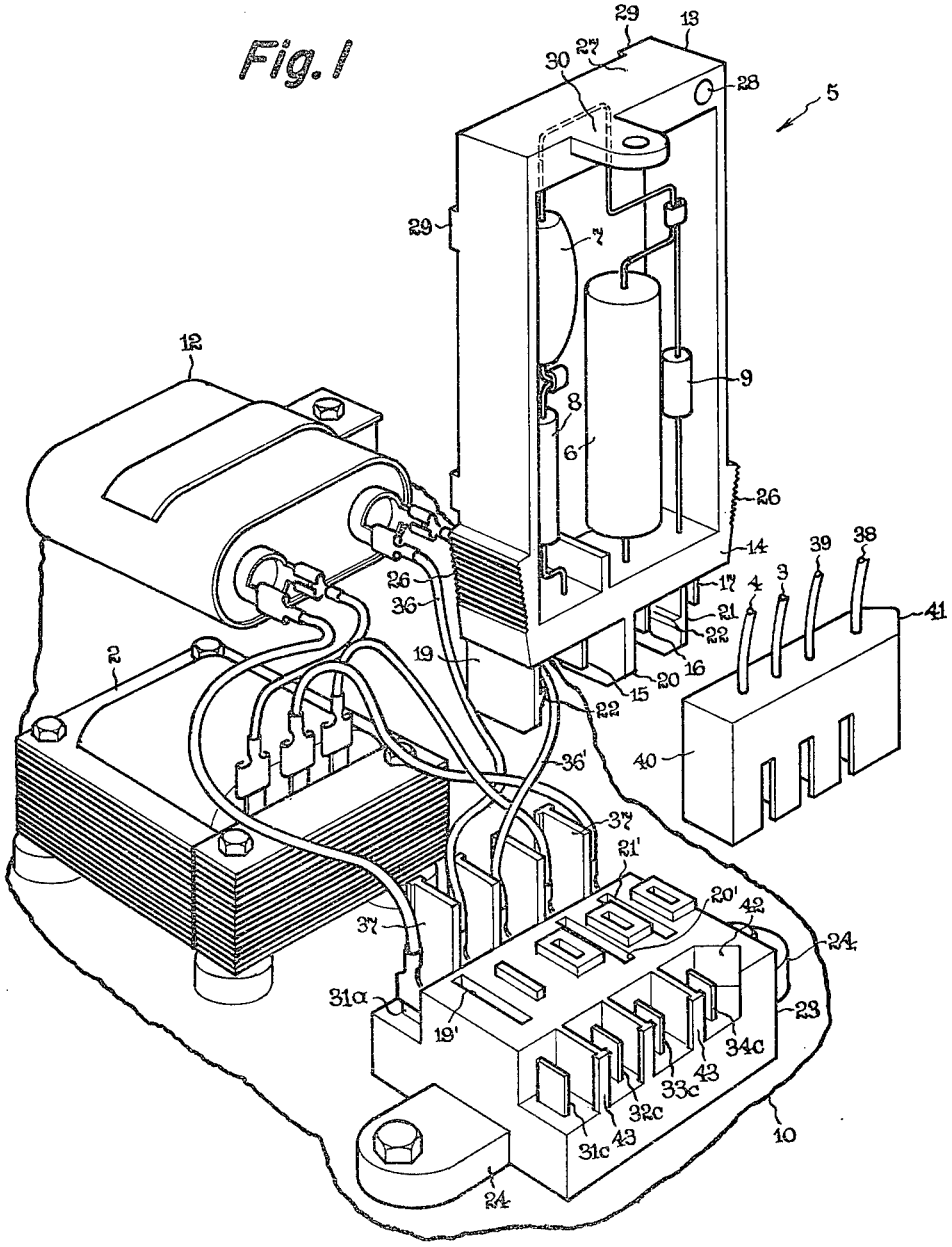
FIG. 1 shows pictorially a connector block embodying the invention with a plug-in starting aid and power module disconnect plug in exploded relationship above it, together with associated ballast components.
Figure 2:
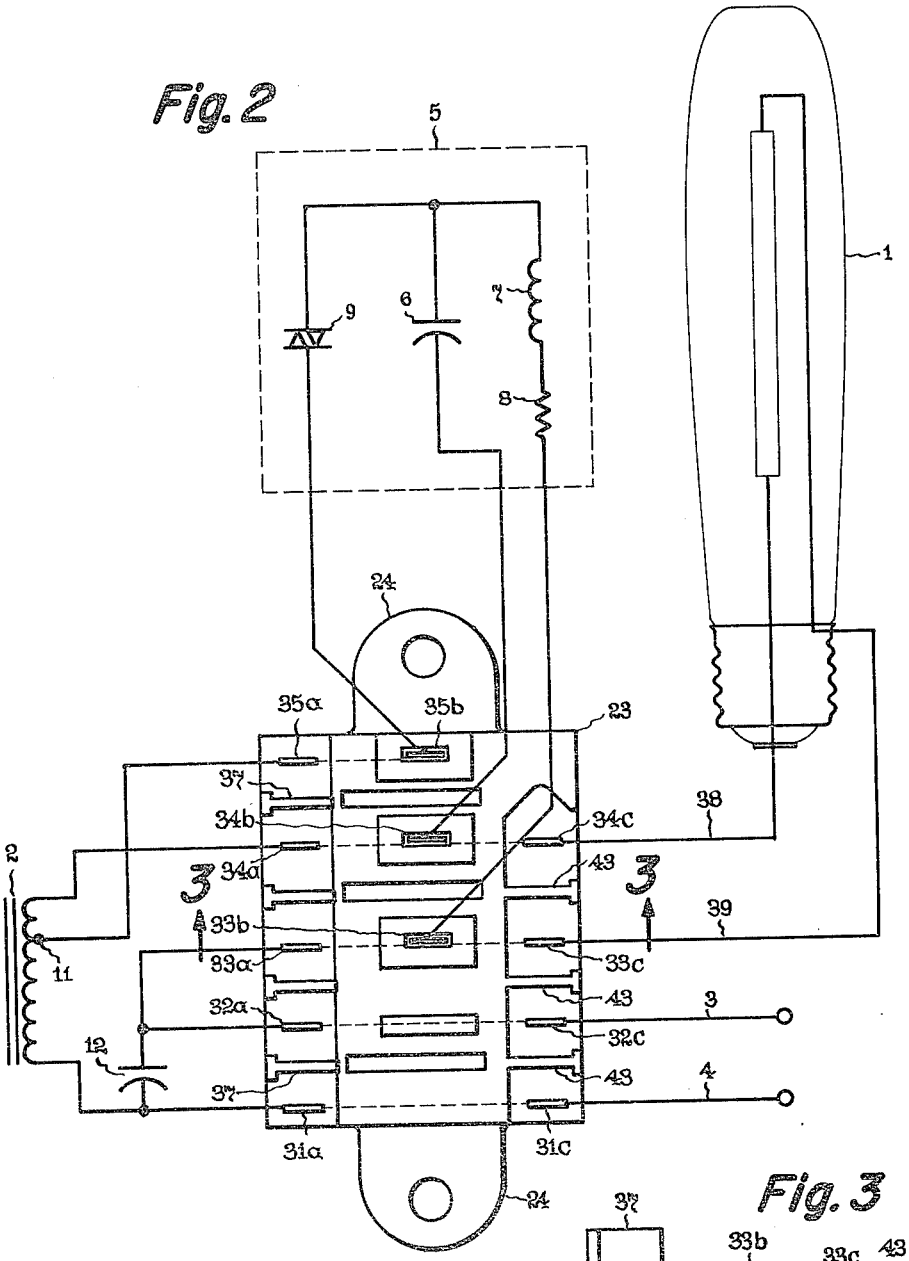
FIG. 2 is a plan view of the connector block with the starting aid and lamp-ballast circuit schematically represented.
Figure 5:
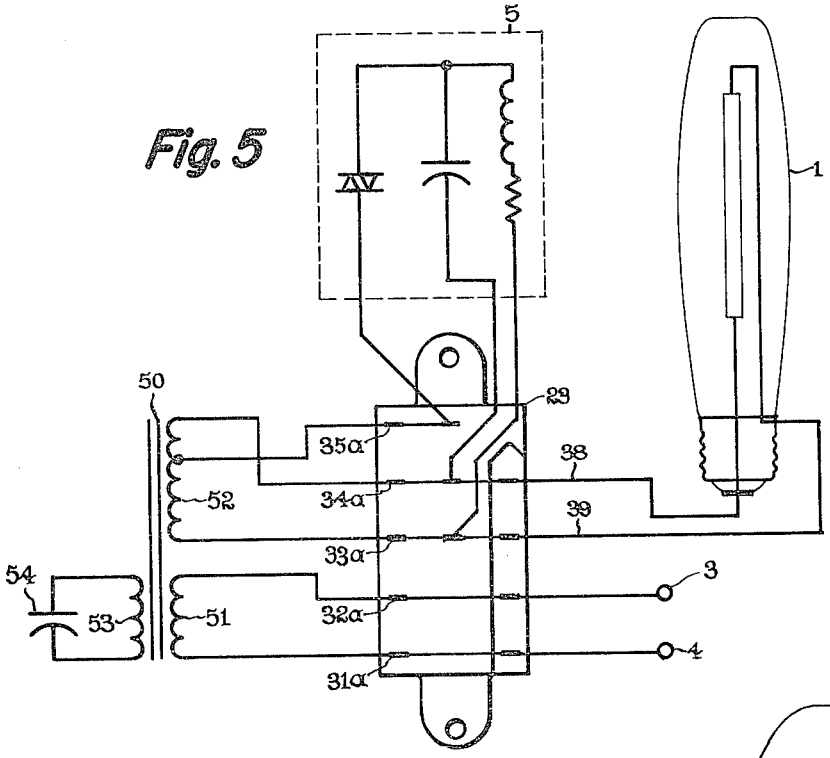
FIG. 5 is a schematic diagram showing the connector used in a magnetic regulator circuit for a high pressure sodium lamp.
Figure 4:
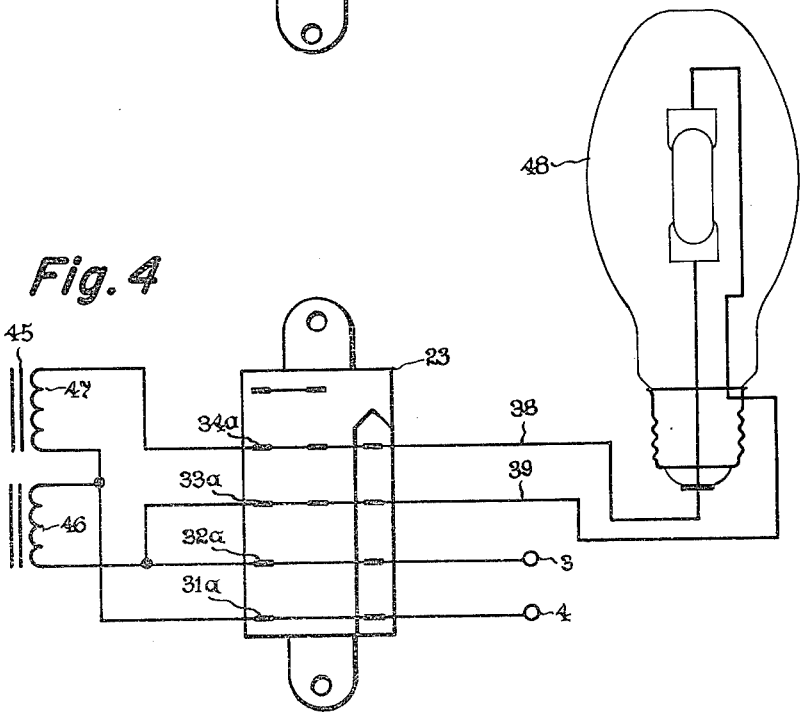
FIG. 4 is a schematic diagram showing the regulator used in a lag circuit for a metal halide lamp.

A multifunction connector block embodying the invention is shown at 23 in FIG. 1, fastened down on power module panel 10. One of its functions is to facilitate the interconnection of ballast components in the power module of a luminaire in a variety of possible circuits. A ballast reactor circuit is shown in FIGS. 1 and 2, and other circuits as shown in FIGS. 4 and 5 by way of example. Another function is to accommodate and connect into circuit a plug-in starter aid 5 when such is needed. Yet another function is to accommodate a disconnect plug 40 which permits quick changeouts of the entire power module.

The circuit resulting from the interconnections illustrated in FIG. 1 is shown schematically in FIG. 2 and corresponds to the circuit of FIG. 1 in U.S. Pat. No. 3,917,976—Nuckolls, whose disclosure is incorporated herein by reference. With this circuit, lamp current into high pressure sodium vapor lamp 1 is limited by ballast reactor 2 connected in series with the lamp across 115 volt, 60 hertz power line 3,4. High voltage high frequency pulses for starting the lamp are generated by starting aid 5 comprising capacitor 6, radio frequency choke coil 7 and resistor 8 connected in series in the order named across the lamp from high to low side. The threaded shell of the lamp base is shown connected through conductor 39 to the low side conductor 3 of the line in accordance with conventional wiring practice. A sidac 9 is connected to tap 11 in ballast reactor 2 and forms a series discharge loop for capacitor 6 through a selected number of turns at the output end of the ballast reactor. Connected across the line at the input side of ballast reactor 2 is a relatively large capacitor 12 which serves both as a high frequency bypass and a power factor improvement capacitor.

Prior to ignition, the voltage across capacitor 6 rises until the breakdown of sidac 9 suddenly discharges the capacitor through the tapped turns of reactor 2. Acting as a pulse transformer, reactor 2 steps up the pulse amplitude to 3000 volts or more which ignites the lamp. After the lamp has started, the pulsing circuit is disabled as a result of the voltage clamping action of the lamp load which prevents the voltage buildup across capacitor 6 from reaching the breakdown level of sidac 9. Reference may be made to the Nuckolls patent for further details on the mode of operation of the circuit.

In the preferred embodiment of the invention illustrated in the several figures, multifunction connector 23 is shaped as a rectangular block with apertured attachment feet 24 to facilitate mounting in the power module. It is made of a moldable plastic, suitably polybutylene terephthalate which is available from General Electric Company under the designation Valox 325. Another suitable plastic material which is cheaper is fiber-glass-filled polypropylene. A number of interconnecting metal strips, five in this instance labeled 31 to 35 are embedded in the plastic block with portions projecting or exposed and accessible to provide terminations. The strips are disposed in parallel side by side relationship with spacing between contiguous strips.

Figure 3:
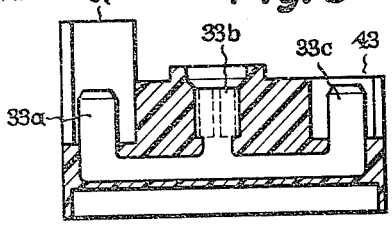
FIG. 3 is side sectional elevation through the connector block taken on line 3—3 in FIG. 2.

According to a feature of the invention, a single universal design of strip is used for all five strips even though various strips present different termination configurations at the surface of the block. As best seen in FIG. 3, representative strip 33 is shaped somewhat like a capital letter E lying on its left side. It has upstanding blade endings 33*a* and 33*c* at opposite ends which function as male terminations, and a female termination 33*b* in the center. The female termination is formed from a T-shaped blade by doubling back the ends of the crossbar of the T.

Less than all the terminations may be used, depending upon the circuit desired to be effectuated and the location of the particular strip in the connector block. Thus by way of example in the block illustrated, strips 31 and 32 have only the male end terminations a and c exposed, the female b terminations being embedded and buried in the plastic to prevent accidental contact. Strips 33 and 34 use all three terminations, male terminations a and c being exposed, and female terminations b being accessible through the top of the block. This allows three different components to be interconnected through each of these strips. Strip 35 has male termination a exposed and female termination b accessible as this strip serves only to connect triac 9 in the starting aid to tap 11 in the ballast reactor.

The five male terminals 31*a* to 35*a* exposed on the rear side of the block as seen in FIG. 1 are for the purpose of accepting individual terminal connectors from the ballast components in the power module, such as reactor 2 and capacitor 12. In the arrangement illustrated, terminal 32*a* is shorted to terminal 33*a* as a result of conductors 36 and 36' both running to the same terminal on capacitor 12, and at the same time the low side 3 of the power line is connected by conductor 39 to the shell side of the lamp. Electrical shorting between strip terminations or accidental contact with them while attaching terminals is prevented by barriers 37 raised out of the insulating plastic material of the body of the block. These barriers give an ample combination of distance and insulation to prevent electrical shorting or arcing.

For greater convenience in effecting changeouts of the power module, line supply conductors 3,4 and conductors 38, 39 leading to the lamp socket in the optics compartment are cabled together and terminated in a four conductor female type disconnect plug 40 illustrated in FIG. 1. The plug is received on the front side of the connector block and is keyed by V-shaped end 41 which limits acceptance into the matching cavity 42 in the block to one orientation. Anti-arcing barriers 43 separate the terminals 31*c* to 34*c*.

Connector block 23 is designed to accommodate in its mid-portion starting aid 5 as a plug-in device. The starting aid components are mounted within a rectangular open plastic frame 13 as more fully described in our copending application Ser. No. 446,804 filed of even date herewith, titled Plug-In Starting Aid, and assigned like the present application. The disclosure of said copending application is incorporated herein by reference. Terminal connectors 15, 16 and 17 project down from the base portion 14 of the frame together with three legs 19, 20 and 21. The center leg 20 is a thicker guide leg assuring alignment when inserted into matching slot 20' in connector block 23. The outer two legs 19 and 21 are thinner but penetrate slots 19' and 21' of the same width as slot 20'. The outer legs form flexible cantilevered beams which bend in their respective slots as the internal hook ridges 22 ride over the shoulders of the slots. The hook ridges serve as latches to provide snap retention and assure positive attachment which vibration will not loosen. When it is desired to unplug the starting aid from the connector block, a good tug will cause the ridges to override the shoulders. The serrated finger grips 26 on the frame walls of the starting aid facilitate unplugging.

A valuable feature of multifunction connector block 23 is its versatility allowing use with a great variety of lamp ballasting circuits, in fact with all commonly used high intensity discharge lamp circuits. It is shown in FIG. 2 connecting a series reactor circuit for a high pressure sodium lamp that requires a starting aid. The identical circuit may be used without the plug-in starting aid for operating a high pressure mercury vapor lamp. A high leakage reactance auto-transformer 45 may be accommodated by connecting its primary 46 to terminals 31*a* and 32*a* and its secondary 47 to terminals 31*a* and 34*a* together with a jumper from 32*a* to 33*a*, as shown in FIG. 4 for operating a metal halide lamp 48. A magnetic regulator transformer 50 may be accommodated by connecting its primary 51 to terminals 31*a*, 32*a*, and its secondary 52 to terminals 33*a* and 34*a*. The tertiary 53 has a capacitor 54 connected directly across it. The tap in the secondary is connected to terminal 35*a* and the circuit is used with plug-in starting aid 5 to operate a high pressure sodium vapor lamp 1. The manner of accommoding other circuits commonly used with HID lamps will be apparent to those skilled in the art.

While the invention has been described with reference to a particular embodiment utilizing a preferred configuration of connector block and arrangement terminations, it will be understood that it is equally applicable to variants of the configuration and circuit arrangement and that numerous modifications may be made by those skilled in the art without departing from the scope of the invention. The appended claims are intended to cover all such equivalent variations as come within the true spirit and scope of the invention.

What we claim as new and desire to secure by Letters Patent of the United States is:

1. A multifunction connector for use in a discharge lamp luminaire comprising:

a plurality of interconnecting strips disposed in spaced side-by-side relationship in a block of insulating material, said strips having three sets of terminations, a first set accommodating a disconnect plug for leads to the line supply and to the lamp, a second set accepting individual terminal connectors of leads from ballast components, and a third set accommoding terminals of a plug-in starting aid.

2. A connector as in claim 1 wherein the interconnecting strips are five in number, four terminations are exposed in the first set to accommodate said disconnect plug, five terminations are exposed in the second set to accept individual terminal connectors, and three terminations are accessible in the third set to the terminals of the plug-in starting aid.

3. A connector as in claim 2 wherein said first and second set of terminations are exposed on opposite sides of the block and said third set of terminations are accessible through the top of the block.

4. A connector as in claim 3 wherein the terminations exposed on opposite sides of the block are male terminals and the terminations accessible through the top of the block are female terminals.

5. A connector as in claim 1 wherein the interconnecting strips are all similar E-shaped metal pieces having blade type male terminals upstanding and exposed on opposite sides of the block and female terminals accessible through apertures in the top of the block to male terminals of a plug-in starting aid.

6. In combination with a multifunction connector for use in the power module of a discharge lamp luminaire, said connector comprising:

a plurality of interconnecting strips disposed in side-by-side relationship in a block of insulating material, said strips having three sets of terminations, a first set accommodating a disconnect plug for leads to the line supply and to the lamp, a second set accepting individual terminal connectors of leads from ballast components, and a third set having intermediate terminations, a plug-in starting aid comprising a frame of insulating material in which electrical components are mounted, and at least three terminals projecting out one side of said frame, said terminals being engageable in said intermediate terminations when said starting aid is plugged into said connector.

7. The combination of claim 6 wherein said first and second set of terminations are exposed on opposite sides of said block and said third set are accessible through apertures in the top of said block.

* * * * *